United States Patent [19]

Halpern

[11] Patent Number: 4,750,283

[45] Date of Patent: Jun. 14, 1988

[54] PICTURE DISPLAY DEVICE

[76] Inventor: Ron Halpern, 12/28 Haraka St., Holon 58423, Israel

[21] Appl. No.: 826

[22] Filed: Jan. 6, 1987

[51] Int. Cl.[4] ..... A47G 1/06

[52] U.S. Cl. ..... 40/152.1; 248/459

[58] Field of Search ..... 40/152.1, 124.1, 10 D, 40/156, 152; 248/459, 460

[56] References Cited

U.S. PATENT DOCUMENTS 2,881,662 4/1959 Harris ..... 40/152.1

4,432,151 2/1984 Morris ..... 40/10 D 4,622,769 11/1986 Friedman ..... 40/152.1

*Primary Examiner*—John J. Wilson

*Assistant Examiner*—Cary E. Stone

*Attorney, Agent, or Firm*—Lieberman, Rudolph & Nowak

[57] ABSTRACT

This invention relates to a device for displaying photographs or other graphic materials. The device is constructed out of two pieces of semi-rigid flexible, transparent plastic material which are pre-folded to form a free standing, display enhancing device.

8 Claims, 2 Drawing Sheets

FIG. 1
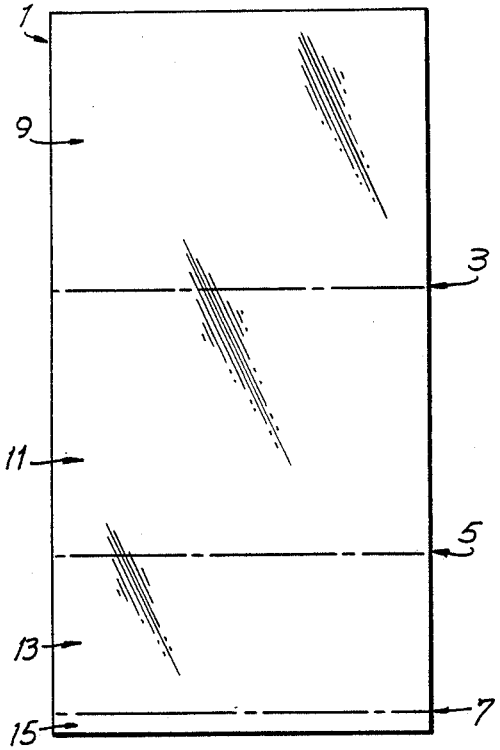
FIG. 2
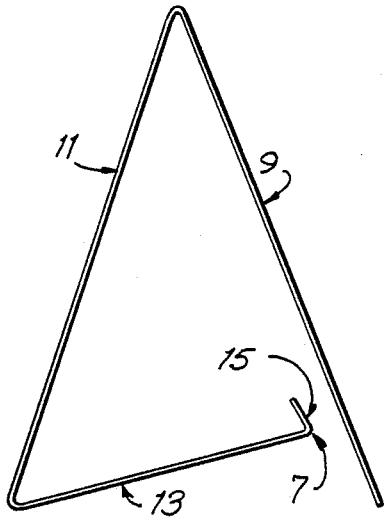
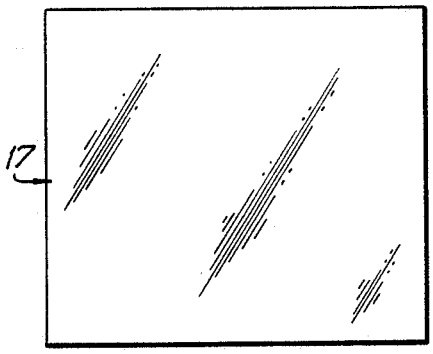
FIG. 3
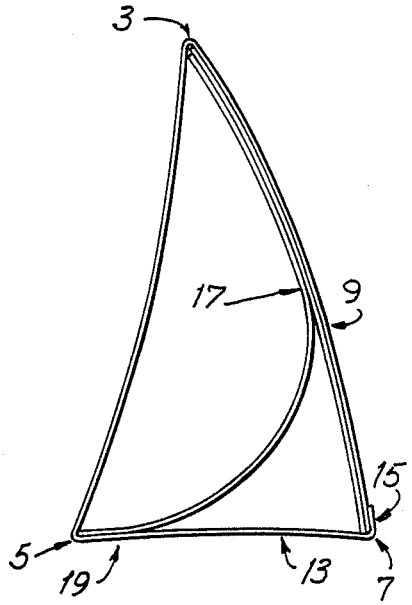
FIG. 4

PICTURE DISPLAY DEVICE

SUMMARY OF THE INVENTION

It is an object of the invention to provide a compact, simply constructed, inexpensive, simple to manufacture, display device for photographs, visuals and graphics.

A further object is to provide a display device which enhances the quality of the displayed material.

A still further object is to provide a display device which can be folded flat for shipping or carrying.

It is a feature of the invention that it is constructed with only two pieces of transparent, semi-rigid plastic material, which securely mounts the material to be displayed and provides protection to the photograph. The structure of the device causes the photograph to assume a slightly convex attitude thereby minimizing the effect of any reflections so as to maximize viewing pleasure.

A still further feature of the invention is that it can be provided with an identifiable logo such as a name, trademark or tag line.

The invention is comprised of two pieces of flexible, semi-rigid material. One piece is formed into a polygon having at least three sides. The second inner piece is a sheet of similar material.

The photograph, drawing or text to be displayed is inserted within the polygon and placed, picture side out, against the display surface of the polygon. The second piece is flexed forming a parabola in side view and inserted within the polygon so that the convex outer surface of the parabola presses against the photograph holding it in place against the display surface of the polygon.

The two edges of the second piece are positioned inside the two ceases on either side of the display surface of the polygon. The outer surface of the apex of the flexed sheet holds the photograph firmly against the display surface of the polygon and causes both the photograph and the display surface to assume a convex shape.

BRIEF DESCRIPTION OF THE DRAWINGS

In the drawings:

FIG. 1 is a perspective view of one piece of the plastic display device in a first embodiment of the invention;

FIG. 2 is a side view of the piece of plastic shown in FIG. 1, pre-folded to form a prism;

FIG. 3 is a perspective view of the second piece of plastic which cooperates with the first piece to form the complete display device;

FIG. 4 is a side view indication of the assembled embodiment with a picture inserted therein;

DETAILED DESCRIPTION

Figure 5:
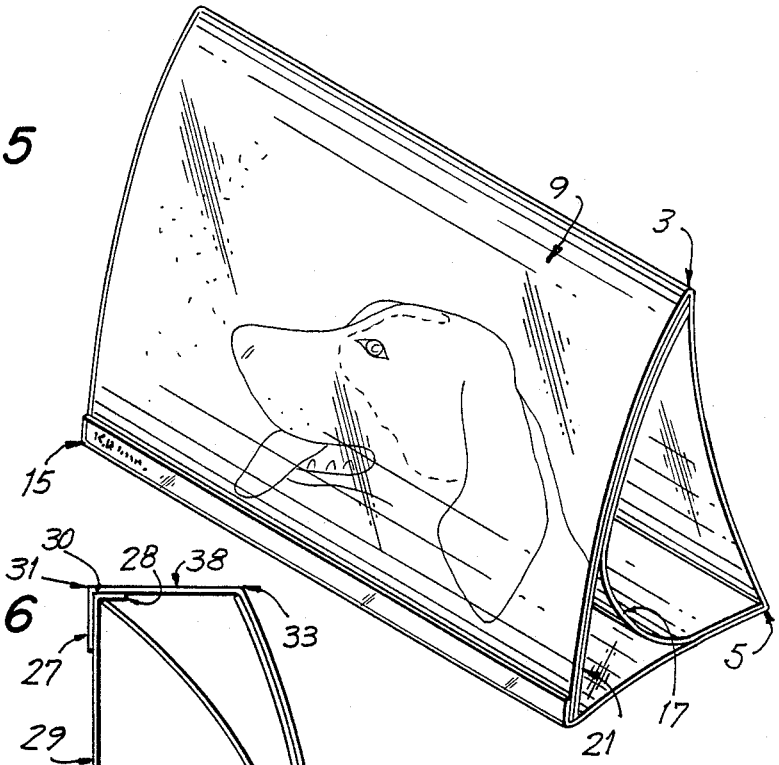
FIG. 5 is an isometric view of the assembled embodiment.

Referring to FIG. 1, there is shown a first piece of generally rectangular, semi-rigid flexible plastic 1. It is shown unfolded prior to being formed and assembled into the invention. Four generally rectangular areas are defined by creases 3, 5 and 7, respectively.

In order to form the first embodiment as shown in end view in FIG. 2, plastic piece 1 is formed along creases 3, 5 and 7, into a roughly prism shape with first, second and third sides 9, 11 and 13, respectively, and a fourth surface, forming a lip 15.

Piece 1 is formed using plastic shaping methods well-known in the art, such as by heating, melting or molding the material. Lip 15 is bent at an angle roughly perpendicular to side 13. Sides 9 and 13 are bent and preferably biased toward the inside surface of side 11.

The creases 3, 5 and 7 divide the length of piece 1 so that the length of side 9 is longer than the length of side 11, which is in turn longer than the length of side 13.

FIG. 3 describes the second generally rectangular piece of semi-rigid flexible plastic 17 having the same width as piece 1 and having a length which is longer than the length of the sides formed by the creases 3, 5 or 7.

FIG. 4 describes the assembled embodiment 19 shown in end view, with a photograph 21 mounted therein. Side 9 is placed behind lip 15. Piece 17 is flexed and inserted into first piece 1 and the edges of piece 17 are held in place by creases 3 and 5. Photograph 21 is placed between the inner surface of side 9 and second piece 17, as shown isometrically in FIG. 5 which, as a result of the side disparity, causes side 9 to assume a convex shape.

FIG. 5 also shows the placing of an identifiable logo 23 on lip 15.

As will be appreciated, a vertically disposed embodiment of the invention can be constructed by making the length of sides 11 and 13 longer than the width of piece 1.

Figure 6:
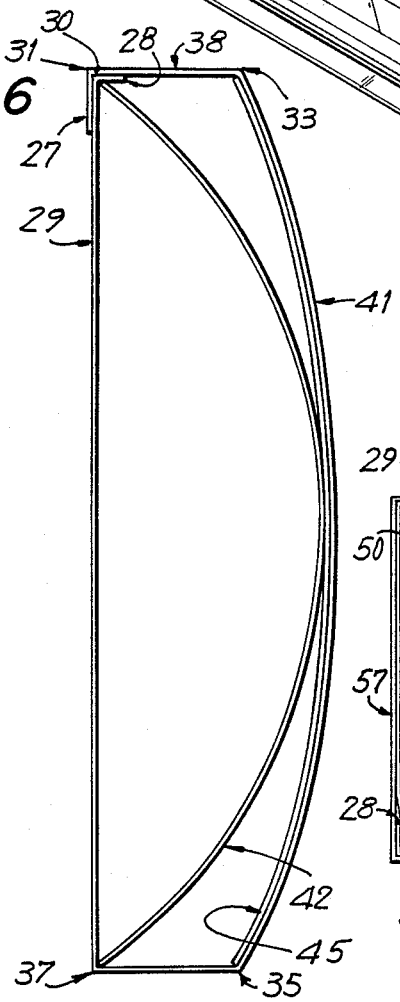
FIG. 6 is a side view of a four-sided embodiment of the invention.

FIG. 6 describes a four-sided embodiment of the invention with a lip 27 and lip 28. A first semi-rigid plastic piece 29 is formed along creases 31, 33, 35, 37 and 30, with one side 38 biased toward side 41 and lip 27 biased toward side 38. A semi-rigid, flexible plastic sheet 42 is flexed to hold photograph 45 against the inner side of display surface 41.

As will be appreciated, this second embodiment can also be utilized as a wall mounted display device.

Figure 7:
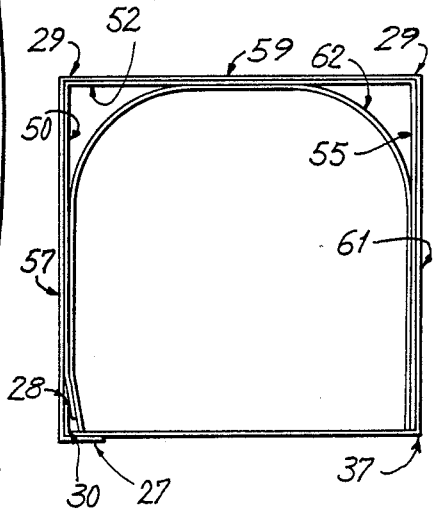
FIG. 7 is a side view of a four-sided embodiment displaying more than one picture.

FIG. 7 describes a third embodiment wherein three photographs 50, 52 and 55 can be held in place against the inner sides of display surfaces 57, 59 and 61 by piece 62.

In both the second and third embodiments shown in FIGS. 6 and 7, the flexible plastic sheet 42 is flexed and inserted into first piece 29. Piece 29 is held in place by creases 30 and 37. Lip 28 is held in place by lip 27.

Preferably, the embodiments shown are of clear polyvinyl chloride (PVC) of various thicknesses. A preferable thickness would be in the range of 0.010" to 0.015". It may be designed to display standard size photographic prints (e.g., 5"×3½" or 6"×4"), in which the length and width of the display surface can be the same as that of the item being displayed.

Other embodiments are possible by altering the dimensions of the display surface to match the size of the item to be displayed and adjusting the dimensions of the sides and second piece depicted hereinabove.

The foregoing disclosure and description of the invention is illustrative and explanatory thereof and various changes in the size, shape and materials as well as in the details of the illustrated construction will still remain within the scope of the invention.

I claim:

1. A two piece display device comprising:

(a) a first piece of generally rectangular, flexible, semi-rigid material having at least three permanent parallel lateral creases having substantially equal lengths defining at least four areas, at least one of said areas having a display surface with an inner side, said first piece, when folded along said creases, forming a polygon in end view, said areas creating at least three sieds of the polygon and at least one lip for confining the movement of one side;

(b) a second piece of generally rectangular flexible, semi-rigid material having a width no greater than the length of said creases and a length greater than any of said areas whereby, when said second piece is inserted inside said polygon with the width of said second piece parallel to said creases and with its edges retained in two of said creases, one or more portions of said second piece bear upon the inner side of the display surface of one or more of said areas thereby providing a picture retaining force between said second piece and said inner sides.

2. The display device of claim 1, wherein said first piece has three permanent parallel lateral creases defining four areas and forming, when folded, along said creases a triangle in end view, the first three of said areas creating first, second and third sides of said triangle and the fourth area creating a lip for confining the outward movement of said first side.

3. The device of claim 2, wherein said first side is greater in area than said second side, which in turn is greater in area than said third side, which in turn is greater in area than said lip.

4. The device of claim 3, wherein said first side is transparent

5. The device of claim 1, wherein the length of said second piece is sufficient to outwardly flex at least one area thereby rendering it convex, minimizing reflection and maximizing viewing pleasure.

6. The device of claim 1, wherein said first and second pieces are transparent.

7. The device as claimed in claim 1, wherein said first and second pieces are two disparate pieces of material.

8. A two piece display device comprising:

(a) a first piece of generally flexible, semi-rigid material having at least three parallel lateral creases defining at least four areas, at least one of said areas having a display surface with an inner side, said first piece, when folded along said creases, forming a polygon in end view, said areas creating at least three sides of said polygon and at least one lip for confining the movement of at least one of said areas;

(b) a second piece of generally flexible, semi-rigid material having a length greater than any of said areas whereby, when said second piece is inserted inside said polygon, one or more portions of said second piece bear upon the inner side of the display surface of one or more of said areas thereby providing a picture retaining force between said second piece and said inner sides.

* * * * *